United States Patent [19]

Bunel et al.

[11] Patent Number: 4,775,428

[45] Date of Patent: Oct. 4, 1988

[54] PRODUCTION OF A STRIP OF ZIRCALOY 2 OR ZIRCALOY 4 IN PARTIALLY RECRYSTALLIZED STATE

[75] Inventors: Gérard Bunel, Rugles; Daniel Charquet, Albertville; Max Dombre, Rugles, all of France

[73] Assignee: Compagnie Europeenne du Zirconium Cezus, Courbevoie, France

[21] Appl. No.: 50,569

[22] Filed: May 18, 1987

[30] Foreign Application Priority Data

May 21, 1986 [FR] France ..... 86 07760

[51] Int. Cl.[4] ..... C22C 16/00

[52] U.S. Cl. ..... 148/11.5 F; 148/133; 420/422; 420/423

[58] Field of Search ..... 148/11.5 F, 133; 420/422, 423

[56] References Cited

U.S. PATENT DOCUMENTS

| | | | |
|---|---|---|---|
| 3,567,522 | 3/1971 | Thomas et al. | 148/11.5 F |
| 3,645,800 | 2/1972 | Mock et al. | 148/11.5 F |
| 3,865,635 | 2/1975 | Hofvenstam et al. | 148/11.5 F |
| 3,963,534 | 6/1976 | Frenkel | 148/133 |
| 4,521,259 | 6/1985 | Eucken | 148/11.5 F |
| 4,584,030 | 4/1986 | McDonald et al. | 148/11.5 F |
| 4,649,023 | 3/1987 | Sabol et al. | 148/11.5 F |
| 4,678,521 | 7/1987 | Yoshida et al. | 148/11.5 F |
| 4,689,091 | 8/1987 | Yoshida et al. | 148/11.5 F |

FOREIGN PATENT DOCUMENTS

| | | | |
|---|---|---|---|
| 2307884 | 11/1976 | France . | |
| 2509510 | 1/1983 | France . | |
| 2540140 | 8/1984 | France . | |
| 0022363 | 2/1983 | Japan | 148/11.5 F |
| 0007027 | 2/1985 | Japan | 148/11.5 F |
| 0817089 | 3/1981 | U.S.S.R. | 148/11.5 F |

*Primary Examiner*—Upendra Roy

*Attorney, Agent, or Firm*—Dennison, Meserole, Pollack & Scheiner

[57] ABSTRACT

The invention concerns a process for the production of a strip of Zircaloy 2 or 4 with an oxygen content of between 900 and 1600 ppm and with mechanical characteristics corresponding to the following three conditions:

$E_{0.2}$ at 315°C. ≧250 MPa

'long' uniform A % at 20°C. ≧4 and
'transverse' uniform A % at 20° C. ≧4, wherein, after hot working of an ingot to provide a billet, said billet is cold rolled to form a strip with intermediate annealing operations, characterized in that:

(a) each of the last two intermediate annealing operations is a treatment of from 0.5 min to 10 min at between 750° and 650° C., (b) the final heat treatment following the last rolling operation is for from 1.5 to 7 min at between 630° and 590° C., and (c) the strip is rolled with particular degrees of deformation for each of the last three rolling operations.

8 Claims, No Drawings

PRODUCTION OF A STRIP OF ZIRCALOY 2 OR ZIRCALOY 4 IN PARTIALLY RECRYSTALLIZED STATE

BACKGROUND OF THE INVENTION

The present invention concerns a process for the production of a strip of zirconium alloy for nuclear use 'Zircaloy 2' (specification ASTM B 52, grades R 60802 and R 60812) or 'Zircaloy 4' (same specification, grades R 60804 and R 60814), resulting in the strip being in a 'restored' state corresponding to a compromise in respect of mechanical strength and ductility. The term 'restored' state is used herein to designate a heat-treated state without complete recrystallisation as in a tempered state in which the stresses due to a cold working operation are at least partly relieved. The present invention also concerns the strip produced.

For the purpose of producing spacer grids which are used in nuclear fuel elements, there is a wish to use strip material of Zircaloy 2 or 4, of a thickness which is typically between 0.3 and 0.9 mm, enjoying both a good elastic limit at the temperature of use and good ductility at ambient temperature (20° C.) as indicated by the uniform elongation in the long direction and also in the transverse direction of the strip, so as to provide a good level of performance in regard to the shaping operations involved in the production of grids. The 'uniform elongation' (elongation is referred to herein by A %) is the maximum elongation of a testpiece in a tensile test, before the onset of a contraction in cross-section.

The characteristics which are thus required in respect of the strip are typically as follows:

$E_{0.2}$ at 315° C.≧250 MPa

Uniform A % in the long direction≧4 and if possible≧5

Uniform A % in the transverse direction≧4 and if possible≧5.

More precisely, the attempt has been made to produce a strip having the above-indicated characteristics by applying thereto, after rolling, a final heat treatment of short duration, for example in the moving mode, either in the air or in a protective atmosphere, possibly followed by a surface treatment.

SUMMARY OF THE INVENTION

The invention concerns a strip of Zircaloy 2 or Zircaloy 4 which typically has:

an oxygen content of between 900 and 1600 ppm, and a carbon content which is preferably between 50 and 160 ppm.

The strip is in a 'restored', partially tempered and more precisely partially recrystallised state, corresponding to the mechanical characteristics set forth in the 'Statement of the problem'. The process for the production of the strip comprises, as is known, hot working of an ingot to form a billet, then cold rolling (temperature of the rolled metal usually between 10° and 50° C.) of the billet to provide a strip with a plurality of intermediate annealing operations, then a final heat treatment on the strip, and optionally then a surface treatment. More particularly, the process of the invention is characterised by the combination of the following steps:

(a) for each of the last two intermediate annealing operations, the strip is subjected to a treatment for from 0.5 min to 10 min at between 650° and 750° C.;

(b) after the last rolling operation the strip is subjected to a final heat treatment for from 1.5 to 7 min at between 590° and 630° C., (c) the strip is rolled with the following degrees of deformation between consecutive annealing or heat treatment operations:

(c1) before the penultimate intermediate annealing operation: 20 to 55%

(c2) between the last two intermediate annealing operations: 30 to 55%

(c3) between the last intermediate annealing operation and the final heat treatment: 30 to 55%.

The degrees of deformation (%) corresponding to each rolling operation or rolling sequence are calculated using the following formula:

$$(1-\text{final thickness}/\text{initial thickness})\times 100.$$

The intermediate degrees of deformation and the conditions in respect of the intermediate tempering operations are so selected that, after each of the intermediate tempering operations, what is obtained is a state in which the metal is just recrystallised, while avoiding an increase in grain size, which makes it possible to obtain an extremely fine equiaxial grain by annealing. The degree of deformation and the conditions in the final heat treatment operation are themselves selected, and these are particularly important points, in such a way that that treatment provides for partial recrystallisation of the strip. Micrographically the strip then comprises very fine grains which are produced by the last intermediate annealing operation and which are elongated by the last rolling operation, the grains often being between 10 and 20 microns in length. Examination under an electron microscope shows that in those elongated grains, there are locally sub-grains of a few microns in diameter which are entirely recrystallised whereas the surrounding matrix has remained in a cold-worked state. The sub-grains in entirely recrystallised state represent a volume of between 20 and 40% of the total.

The required mechanical characteristics are attained at the same time as that particularly fine structure, making it possible to have a very good surface state after forming.

So as to produce the required structure and mechanical characteristics with a very high degree of regularity and in order also to be able to improve them in a reliable fashion, the final heat treatment is preferably carried out in a moving mode at between 600° and 625° C., the constant speed of movement of the strip ensuring a holding time of from 2 to 5 minutes. Preferably also, independently of or in combination with the foregoing step, the strip is rolled between the last intermediate tempering operation and the final heat treatment with a degree of deformation of 35 to 45%.

As has been shown hereinbefore, the deformation operations and the two preceding intermediate annealing operations also play a part in obtaining and improving the surprising compromise in respect of the characteristics of the strip according to the invention. Adjustment of these intermediate annealing operations is then particularly desirable (producing states which are just 100% recrystallised), and it is preferable to narrow the conditions in respect of duration and temperature of said last two intermediate tempering operations: each then comprising, for the strip, a residence time of from 1 to 3 minutes at between 680° and 720° C., whether what is involved is the general case or the process in the form in which it has already been improved in regard to the final heat treatment or the final degree of deformation. An optimum comprises effecting the last two intermediate annealing operations as well as the final heat treatment in a moving mode at a constant speed, each of the two intermediate annealing operations then preferably being carried out at between 680° and 720° C. with a speed of movement such as to ensure a holding time at the treatment temperature for from 1 to 3 minutes.

The final heat treatment is also preferably carried out in a moving mode in a protective atmosphere or possibly in air, and it is then followed either by a pickling operation, or a slight surface cleaning operation which is itself followed by a pickling operation.

When the heat treatment is effected in the moving mode or in a tunnel furnace under a protective atmosphere based on argon or helium or nitrogen or an argon+helium or argon+nitrogen mixture, the protective gas is preferably under a slightly increased pressure in the heating chamber and at the outlet of the heating chamber, the strip passes into a lock or into a cooling chamber where it is cooled to below 300° C. by blowing in cold inert gas.

The invention also concerns the strip according to the invention which, with its particular composition and mechanical characteristics, is distinguished in particular from the previously known strips by virtue of a particularly fine grain, the grain being finer in cross-section than the index ASTM '11' with partial recrystallisation affecting 20 to 40% of the volume.

DESCRIPTION OF THE PREFERRED EMBODIMENTS

The invention will be better appreciated from the tests which are set out hereinafter.

TESTS EFFECTED first series of tests

This series of tests concerns a strip of Zircaloy 4 (nominal composition: Sn 1.5%—Fe 0.2%—Cr 0.1%—Zr the balance), from a casting operation X with an oxygen content of 1290 ppm and a carbon content of 90 ppm, rolled to a thickness of 0.44 mm. The final degree of deformation was 43% and the final heat treatment was carried out in a static mode under vacuum as was then the usual practice at 460° C. for a period of 24 hours, the intermediate annealing operations themselves being for from 3 to 4 hours at 650°/700° C.

The measured mechanical characteristics were as follows:

at ambient temperature, in the transverse direction:
breaking stress R=550 to 570 MPa
$E_{0.2}$=510 to 530 MPa
A %=17 to 21
Uniform A %=4 to 5;
at ambient temperature, in the long direction:
Uniform A %=5 to 7
at 315° C., in the long direction:
$E_{0.2}$=300 to 320 MPa.

The heat-treated samples have a recrystallised grain deformed in the long direction, corresponding in cross-section to the index ASTM '10'.

When viewed through a transmission electron microscope, the samples present a very low degree of recrystallisation of between 0.5 and 5% of the volume.

Those production conditions suffer from the disadvantage of involving a final heat treatment which is of long duration, and giving a fairly wide scatter of results in regard to the desired characteristics.

second series of tests

This series of tests concerns a strip of Zircaloy 4 according to the invention resulting from a casting operation Y with an oxygen content of 1360 ppm and a carbon content of 120 ppm, rolled to a thickness of 0.43 mm, the series of transformation operations being as follows:

(1) Hot rolling to a thickness of 6 mm,
(2) static annealing in a flat condition: 3 to 4 hours at 650°/700° C.,
(3) CR (cold rolling) to 3.5 mm,
(4) static annealing in the flat condition: 3 to 4 hours at 650°/700° C.,
(5) CR to 2.5 mm, welding in a spool, then CR to 1.85 mm (degree of deformation from 3.5 mm: 47%),
(6) annealing in a moving mode: 3 minutes at 700° C. (1.5 m/min),
(7) CR to 1.45 mm (22%),
(8) annealing in a moving mode: 3 minutes at 700° C. (1.5 m/min),
(9) CR to 0.75 mm (48%),
(10) annealing in a moving mode: 2½ minutes at 700° C. (2 m/min),
(11) CR to 0.43 mm (43%),
(12) final heat treatment in a moving mode under argon at 605° C., causing each portion of the strip being treated to be held at 605° C. for 4 minutes.

The value of the successive degrees of deformation in steps (7), (9) and (11) resulted from successive tests, the levels thereof and the conditions in the heat treatment operation following each of the last three rolling operations acting in combination on the mechanical characteristics and the structure of the strip produced.

The heat treatment operations in a moving mode were carried out in a furnace operating with a protective argon atmosphere. The speed of movement of the strip was so selected as to give the desired residence time at the appropriate temperature, for each portion of the strip being treated. Each of the three intermediate annealing operations in a moving mode gives the strip a state in which it is just recrystallised with a very fine grain size, on the basis of examination carried out using an electron microscope.

The measured mechanical characteristics of the strip were as follows:

at ambient temperature, in the transverse direction:
breaking stress=591 MPa
$E_{0.2}$=552 MPa
transverse uniform A %=4.6%
at 315° C., in the long direction:
$E_{0.2}$=298 MPa.

The size of the fine grain which is recrystallised in the last intermediate tempering operation, as measured in cross-section, is from '11' to '11.5' ASTM. The final recrystallisation as viewed through an electron microscope is very fine and affects 20 to 40% of the volume.

Examinations in respect of texture were also carried out on a sample of strip, giving figures in respect of poles 002, on which the Kearn factors were measured as follows:

$f_N=0.70$ $f_T=0.21$ $f_L=0.09$

The difference between $f_T$ and $f_L$ shows that the degree of anisotropy remains relatively low, which is favourable in regard to the level of performance in a reactor, deformation of the grids then being less troublesome in that situation (less distortion phenomena in operation). The strip produced thus affords a good compromise between suitability for stamping or pressing and textural isotropy.

third series of tests

This series of tests concerns a strip from the same casting operation Y which is transformed in the same manner except for the final heat treatment (operation 12) ) which was carried out under the same conditions as the first series of tests: under vacuum at 460° C. for 24 hours.

The measured mechanical characteristics were as follows:

at ambient temperature, in the transverse direction:
breaking stress R=608 MPa
$E_{0.2}$=572 MPa
transverse uniform A %=3.8%
at 315° C., in the long direction:
$E_{0.2}$=330 MPa.

From tests in respect of forming, corresponding to some of the characteristics of the strip, that strip is excessively rigid (high value in respect of transverse $E_{0.2}$) and difficult to shape (see also the transverse distributed elongation %).

fourth series of tests

This series of tests concerns a strip from the same casting operation Y, which is transformed in accordance with the process of the invention, using the same steps (1) to (11) as the strip of the second series of tests, with the final heat treatment (operation 12) ) being carried out under the following conditions:

Treatment in a moving mode under argon at 620° C., resulting in a holding time of about 2.5 minutes at that temperature.

The measured mechanical characteristics were as follows:

at ambient temperature, in the transverse direction:
breaking stress=573 MPa
$E_{0.2}$=534 MPa
transverse uniform A %=5.6%
at 315° C. in the long direction:
$E_{0.2}$=285 MPa.

The size of the fine grain which is recrystallised in the last intermediate annealing operation is the same as in the second series of tests (only the final heat treatment is different). Final recrystallisation affects 20 to 40% of the volume.

That strip is a little less rigid and a little easier to shape than that in the second series of tests.

The process of the invention therefore provides for precise controls in respect of quality, with results which can be particularly well reproduced in the case of treatment operations in a moving mode.

We claim:

1. A process for the production of a strip of Zircaloy 2 or Zircaloy 4 comprising the steps of:

(a) forming an ingot of Zircaloy 2 or 4 having an oxygen content of 900 to 1600 ppm;

(b) hot rolling said ingot to form a billet;

(c) cold rolling said billet a plurality of times with intermediate annealing steps therebetween to form a strip, said cold rolling comprising the following final steps:

cold rolling with a deformation degree of 20 to 55%;

annealing the strip obtained thereby for 0.5 to 10 minutes at between 650° and 750° C.;

cold rolling the annealed strip in a penultimate step with a deformation degree of 30 to 55%;

annealing the strip obtained in the penultimate cold rolling step for 0.5 to 20 minutes at between 650° and 750° C.;

cold rolling the strip in a final step with a final deformation degree of 30 to 55%; and (d) subjecting the strip obtained in said final cold rolling step to a final heat treatment for 1.5 to 7 minutes at between 590° and 630° C.;

whereby the strip obtained has an elastic limit at 315° C. of at least 250 MPa, and a good ductility at 20° C. with a uniform elongation in the longitudinal direction of at least 4% and a uniform elongation in the transverse direction of at least 4%.

2. A process according to claim 1 wherein the final heat treatment is carried out in a moving mode at between 600° and 625° C., at a constant speed ensuring a holding time at the treatment temperature of from 2 to 5 minutes.

3. A process according to claim 1 wherein, for each of the last two intermediate annealing operations, the strip is subjected to a treatment for from 1 to 3 minutes at between 680° and 720° C.

4. A process according to claim 1, wherein each of the last two intermediate annealing operations is carried out in a moving mode at between 680° and 720° C., at a constant speed ensuring a holding time at the treatment temperatures of from 1 to 3 minutes.

5. A process according to claim 1, wherein each intermediate annealing operation results in Zircaloy which is just recrystallized, without an increase in grain size.

6. A process according to claim 1, wherein the final heat treatment results in partial recrystallization of the strip.

7. A process according to claim 2 wherein the strip is rolled between the last intermediate annealing operation and the final heat treatment, with a degree of deformation of 35 to 45%.

8. A process according to claim 2 wherein each of the last two intermediate annealing operations is carried out in a moving mode at between 680° and 720° C., at a constant speed ensuring a holding time at the treatment temperature of from 1 to 3 minutes.

* * * * *